US007628353B2

(12) United States Patent
Peterson

(10) Patent No.: US 7,628,353 B2
(45) Date of Patent: Dec. 8, 2009

(54) DELAYED TAIL FIN DEPLOYMENT MECHANISM AND METHOD

(75) Inventor: William S. Peterson, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 394 days.

(21) Appl. No.: 11/559,465

(22) Filed: Nov. 14, 2006

(65) Prior Publication Data

US 2008/0111020 A1 May 15, 2008

(51) Int. Cl.
*F42B 10/14* (2006.01)

(52) U.S. Cl. ..... 244/3.28; 244/3.29

(58) Field of Classification Search ..... 244/3.23, 244/3.27, 3.28, 3.29
See application file for complete search history.

(56) References Cited

U.S. PATENT DOCUMENTS

| | | | | |
|---|---|---|---|---|
| 2,793,591 | A | 5/1957 | Jasse | |
| 3,125,956 | A * | 3/1964 | Kongelbeck | 244/3.29 |
| 3,260,205 | A | 7/1966 | Dietrich | |
| 3,697,019 | A | 10/1972 | Watson | |
| 4,296,895 | A * | 10/1981 | Pazmany | 244/3.29 |
| 4,440,360 | A | 4/1984 | Hallstrom | |
| 4,520,972 | A | 6/1985 | Diesinger et al. | |
| 4,664,338 | A | 5/1987 | Steuer et al. | |
| 4,817,891 | A | 4/1989 | Gaywood | |
| 5,368,255 | A * | 11/1994 | August | 244/3.28 |
| 6,168,111 | B1 | 1/2001 | Kayser et al. | |
| 6,588,700 | B2 | 7/2003 | Moore et al. | |
| 6,764,042 | B2 | 7/2004 | Moore et al. | |

OTHER PUBLICATIONS

D.J. Wilson, "Delayed Fin Deployment Mechanism", Lockheed-Huntsville Research and Engineering Center, Huntsville Alabama 1978.

* cited by examiner

*Primary Examiner*—Rob Swiatek
(74) *Attorney, Agent, or Firm*—Eric A. Gifford

(57) ABSTRACT

A hold down device positioned on the projectile to exert a known spring force in opposition to the centrifugal force provides an inexpensive, light weight and reliable delayed fin deployment mechanism for boosted fin-stabilized spinning projectiles. When the forcing moment produced by the centrifugal force acting on the fin exceeds the opposing moment produced by the hold down device, the hold down device will release the fin allowing it to swing into its deployed position. Thus, proper selection of the spring force and positioning of the hold down device will cause the fins to deploy at a predetermined spin rate. The spin rate can be correlated to a time or travel distance of the projectile from launch. The incorporation of the hold down devices requires minimal design changes to existing rockets and may, in some cases, be retrofit to the existing base of rockets if desired.

20 Claims, 12 Drawing Sheets

DELAYED TAIL FIN DEPLOYMENT MECHANISM AND METHOD

BACKGROUND OF THE INVENTION

1. Field of the Invention

This invention relates to fin-stabilized projectiles and more particularly to a mechanism for delayed tail fin deployment.

2. Description of the Related Art

Modern warfare is based on mission speed, high per round lethality, and low possibility of collateral damage. This requires that the ordinance be delivered on target with high precision. An important component to achieving high precision is to maintain the stability of the projectile delivering the ordinance. High spin rate projectiles such as bullets, artillery shells or ballistic missiles are self-stabilizing ("spin-stabilized"), the projectile acts like a gyro which prevents the projectile from tumbling. Low spin rate projectiles such as rockets (guided or unguided) deploy tail fins to shift the center of pressure aft of the center of gravity to ensure stability ("fin-stabilized"). Roll-stabilized projectiles such as guided missiles use active control of tail fins and other aerodynamic surfaces to provide stabilization.

An exemplary weapon system 10 is illustrated in FIGS. 1, 2 and 3*a*-3*b*. In this example, the weapon system is a multi-tube rocket launcher 11 mounted on a helicopter 12 that fires rockets 13. Tail fins 14 are stowed in a spring-loaded overlapping (FIG. 3*a*) or wrap-around design around the circumference of rocket tail section 15 while inside the tube 16. The tail section also includes a nozzle 17 and rocket motor (not shown) to provide boost. To provide some stability the rocket nozzles are scarfed at an angle to impart a slight spin to the rocket during flight, e.g. 20-60 cycles/second typically. Alternately, vanes could be positioned aft of the nozzle to impart the spin. The tail section 15 is coupled to the main body 18 of the projectile on which a warhead 19 and fuze 20 are attached. As shown, rockets 13 are unguided, simply point and shoot. A guidance package could be inserted between the warhead and main body in which case additional canards would be controlled to guide the rocket based on, for example, GPS or sensor data. Also, individual rockets may be launched from a pylon instead of a tube.

As shown in FIG. 3*a*, as the rocket spins up in the launch tube 16 a centrifugal force 24 is generated that produces a rotational moment on the fins about their respective rotation pins 26. Once clear of the tube, absent some additional restraint, centrifugal force 24 will immediately rotate the fins to their deployed positions as shown in FIG. 3*b*. Spring loading adds to the centrifugal force to deploy the fins more quickly and with less variation. This "passive-passive" system e.g. passive deployment and passive control, is inexpensive, lightweight, low volume and reliable. The fins, once deployed, are typically held in position by a locking mechanism. Deployment is immediate upon clearing the launch tube. There is no capability to delay or control fin deployment to, for example, avoid interference with adjacent rockets or to mitigate the effects of boost-phase winds associated with, for example, the flow field of the helicopter.

D. J. Wilson "Delayed Fin Deployment Mechanism" (Lockheed-Huntsville Research and Engineering Center, Huntsville Ala. 1978) describes an "active-passive" system that provides for delayed deployment but at significantly higher cost, weight, and volume. A timing circuit fires a bridge wire activated cable cutter squib after a precise time delay initiated by the rocket ignition pulse. The squib, in turn, clips and thus releases a stainless steel cable which had previously maintained the spring-loaded fins in a folded position.

Each (of two) timer circuit/squib units with batteries is contained in a package approximately the size of a pack of cigarettes.

Some systems use the tail fins to provide both stability and guidance control instead of using additional canards. These "active-active" systems are quite expensive and large as they must provide both the actuator mechanism to physically adjust the fins and the intelligence to proportionally control the actuator mechanism in Teal-time to guide the rocket. The actuator mechanism may be mechanical, electromagnetic or possibly electrostatic. This guidance capability is more than sufficient to delay deployment of the tail fins but at a high cost.

A need remains for a fin deployment mechanism having rudimentary timing control that does not sacrifice cost, weight, volume or reliability. Ideally, such a fin deployment mechanism should require minimal redesign of existing rockets with the potential to retrofit the existing inventory of rockets.

SUMMARY OF THE INVENTION

The present invention provides an inexpensive, light weight, low volume and reliable delayed fin deployment mechanism for boosted fin-stabilized spinning projectiles.

This is accomplished with a hold down device that holds the fin in its stowed position with a constant spring force. During the boost stage, the projectile spins up to its terminal spin rate. The spring force is selected to correspond to a particular spin rate of the projectile (less than the terminal spin rate), which in turn is correlated to a desired travel distance of the projectile from launch. When the spin rate reaches the target value the rotational moment produced by the centrifugal force exceeds the opposing moment produced by the spring force and the hold down device releases the fin to pivot outwardly to its deployed position. The hold down device provides a very simple and reliable solution to allow a boosted spinning projectile to, for example, clear an aircraft's flow field and/or other projectiles in a multi-tube launcher.

A typical projectile will include a plurality of fins positioned around the circumference of the projectile's tail section. In one embodiment, each fin will be provided with a hold down device. Ideally each device will exhibit the same spring force so that all of the fins deploy at the same time. However, inevitably there is some variation in the spring forces that causes a degree of dispersion at the target. In another embodiment, a plurality of cams are positioned between adjacent fins so that when the hold down device having the weakest spring force releases, the deployment of its fin pushes the cam against the adjacent fin causing its hold down device to release and so forth in a daisy chain until all of the hold down devices have been released and the fins deployed. The cams should reduce dispersion at the target. In yet another embodiment, only a primary fin is held in place with a hold down device. The remaining secondary fins are captured by a lanyard that is held between a pair of attachment lugs. The deployment of the primary fin releases the lanyard from at least one of the attachment lugs thereby allowing the secondary fins to deploy almost simultaneously.

These and other features and advantages of the invention will be apparent to those skilled in the art from the following detailed description of preferred embodiments, taken together with the accompanying drawings, in which:

DETAILED DESCRIPTION OF THE INVENTION

The present invention provides an inexpensive, light weight and reliable delayed fin deployment mechanism for boosted fin-stabilized spinning projectiles. A hold down device is positioned on the projectile to exert a known spring force in opposition to the centrifugal force. When the projectile is launched it is boosted and spins up to a terminal spin rate. The centrifugal force increases with the square of the spin rate. When the moment produced by the centrifugal force acting on the fin exceeds the opposing moment produced by the hold down device, the hold down device will release the fin allowing it to swing into its deployed position. Thus, proper selection of the spring force and positioning of the hold down device will cause the fins to deploy at a predetermined spin rate. The spin rate can be correlated to a time or travel distance of the projectile from launch. Thus, the hold down device(s) provides a simple yet effective means for delayed fin deployment in a boosted fin-stabilized spinning projectile. The incorporation of the hold down devices requires minimal design changes to existing rockets and may, in some cases, be retrofit to the existing base of rockets if desired.

Figure 4:
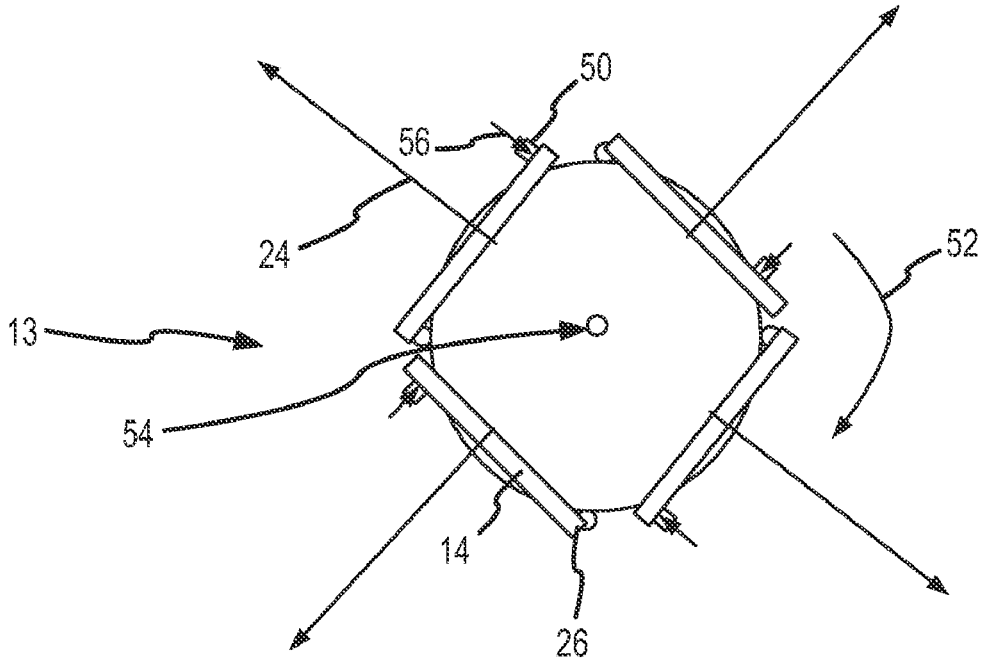
FIG. 4 is a section view of the spinning projectile illustrating a hold down spring force that opposes the centrifugal force to delay deployment of the fins in accordance with the present invention.
Figure 5A:
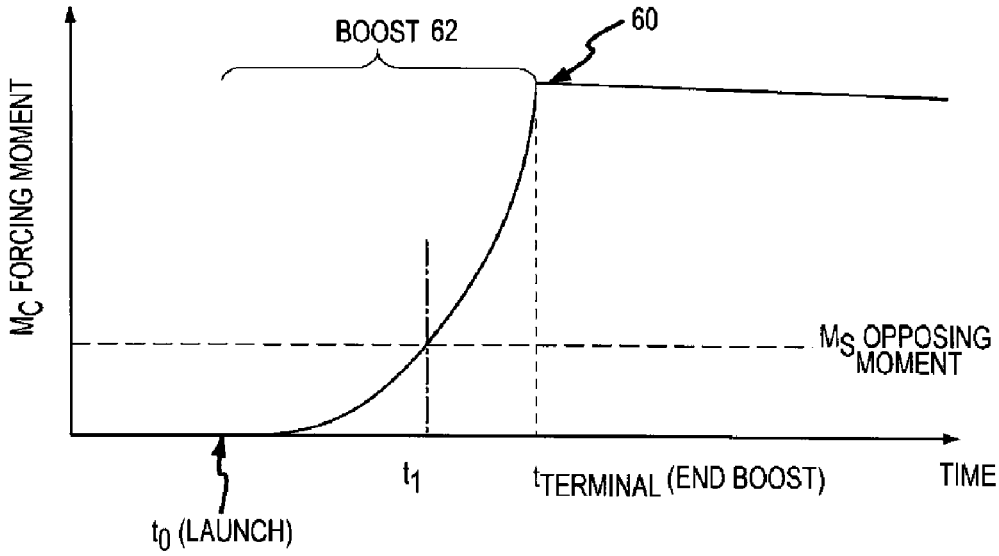
FIGS. 5*a*-5*b* are plots of the forcing moment and travel as the boosted projectile spins up, respectively.
Figure 5B:
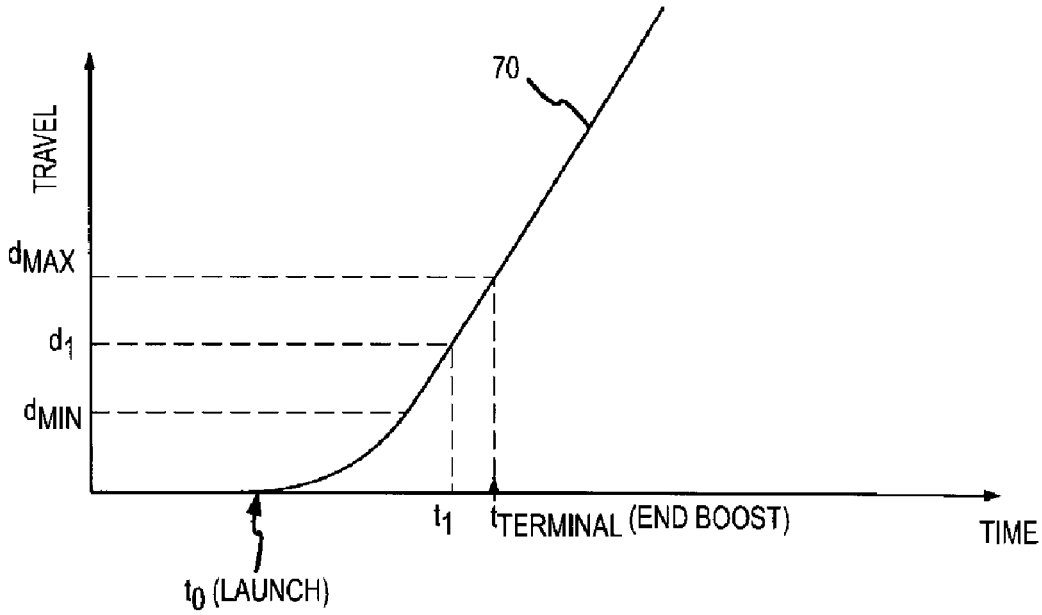

As shown in FIGS. 4 and 5*a*-5*b*, a hold down device or devices 50 are positioned around the circumference of projectile 13 to restrain fins 14 in their stowed position as the projectile spins 52 around its axis 54. The hold down device exerts a constant spring force 56 on the fin that opposes centrifugal force 24. Centrifugal force 24 is given by $F_c=m*s^{2*}r$ lb where m is the mass of the projectile, r is the radius from the spin axis to the fin center of mass and s is the spin rate. The centrifugal force acting through the center of mass of the fin produces a moment $M_C=d_F*F_C$ where $d_F$ is the distance from fin rotation pin 26 to the center of mass of the fin. Spring force 56 is determined by the design of a particular hold-down device 50. The opposing moment $M_s=d_s*F_S$ where $d_s$ is he distance from fin rotation pin 26 to hold-down device 50 and $F_S$ is the spring force. Thus, the forcing moment $M_C$ is dictated by projectile and fin design and by the boost. The opposing moment $M_S$ is set through a combination of the spring force and the placement of the hold-down device.

Figure 2:
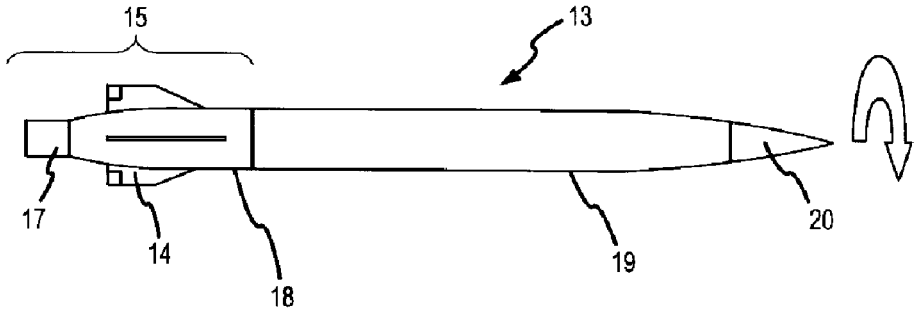
FIG.2 (PRIOR ART)
FIG. 2, as described above, is a diagram of a fin-stabilized rocket.
Figure 3A:
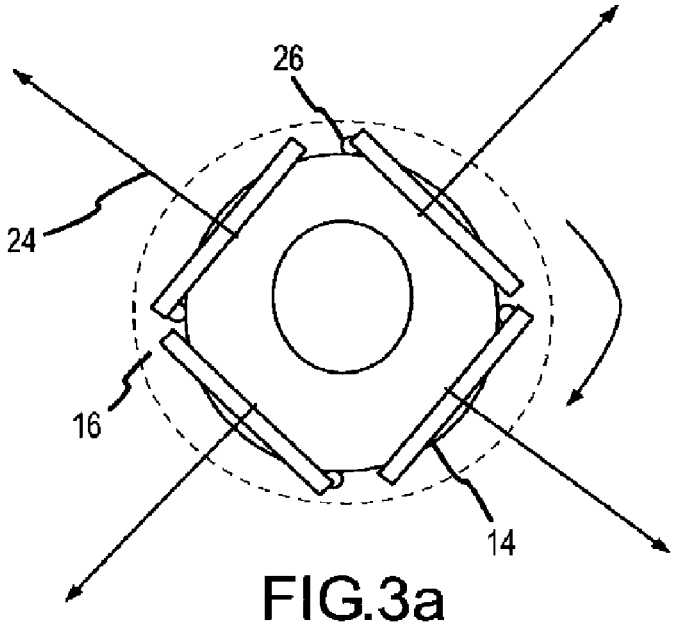
FIG.3a (PRIOR ART)
FIGS. 3*a*-3*b*, as described above, are section views of the spinning rocket illustrating the centrifugal forces on the stowed fins in or out of the launch tube and the fins in their deployed positions post launch out of the launch tube.
Figure 3B:
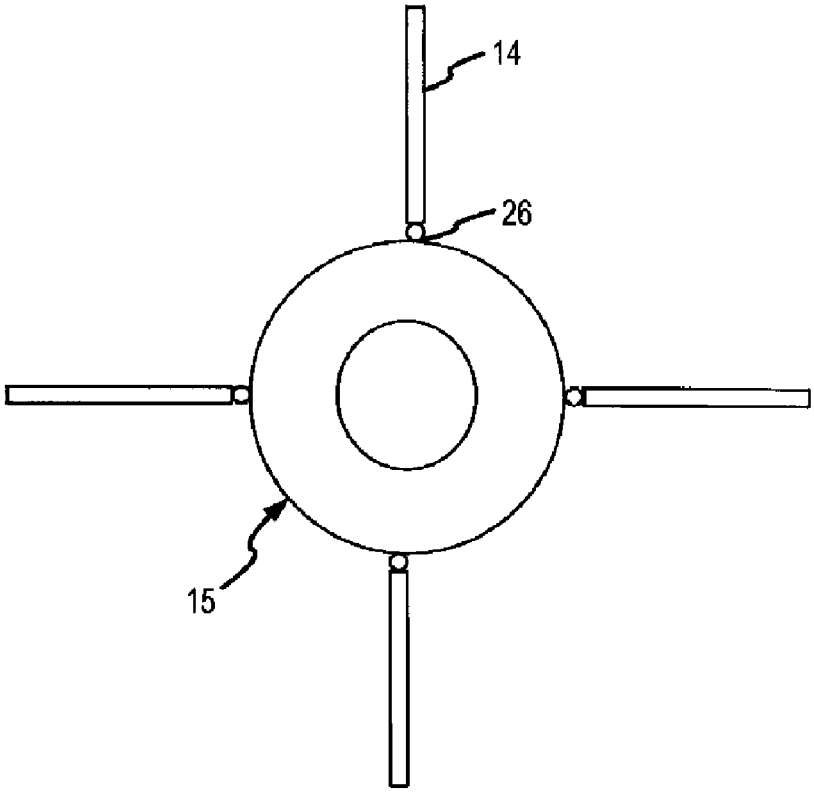
FIG.3b (PRIOR ART)

As shown in FIG. 5*a*, in a "boosted" projectile the spin rate, hence centrifugal force and moment $M_C$ spins up from zero to a terminal or maximum value 60 during the boost phase 62. The projectile, as shown in FIG. 2, includes a rocket motor and nozzle that propels the projectile towards the target and induces spin such as found in surface-to-air or air-to-air rockets and missiles. The boost phase of a typical rocket is, for example, 1 to 0 seconds in duration during which time the spin rate, hence centrifugal force is increasing. Thus, the boost phase 62 defines a time window from to at launch to $t_{terminal}$ at the end of the boost phase in which to delay the deployment of the tail fins. Hold-down device 50 is designed and positioned to produce an opposing moment $M_S$ that lies somewhere above the minimum moment $M_C=0$ and somewhere below the maximum moment at the terminal spin rate. The tail fins will deploy at a time $t_1$ when moment $M_C$ exceeds the opposing moment $M_S$.

As shown in FIG. 5*b*, the travel 70 of the projectile can be accurately plotted against time for a given projectile design and boost. Tail fin deployment can be delayed to correspond to a desired travel distance of the projectile up to a maximum travel delay $d_{max}$ corresponding to the end of the boost phase. Once boost is completed, the spin rate, hence moment $M_C$ will not get any larger and will actually reduce slightly due to aerodynamic drag effects. Assuming a battlefield scenario requires the projectile to travel at least a distance $d_{min}$ before the fins are deployed, a designer might select a distance $d_{min}<d_1<d_{max}$. How close the designer sets $d_1$ to $d_{min}$ may depend on a number of considerations including the manufacturing tolerance of the actual spring force to the design value, the accuracy with which travel is known as a function of time for a particular projectile and boost, the criticality of not deploying the fins early and conversely the criticality of not deploying the fins too late. The selection of $d_1$ determines the time of deployment $t_1$, which in turn determines the opposing moment $M_S$. The design can than select the spring force of the hold-down device and the position of the hold-down device to achieve the required moment.

The hold down device provides a very simple and reliable solution to allow a spinning projectile to, for example, clear an aircraft's flow field and/or other projectiles in a multi-tube launcher. In both instances, the travel delay can be established a priori based on knowledge of the aircraft or the multi-tube launcher. For example, a designer can estimate that for a certain type of helicopter when hovering to fire its rockets the flow field produced by the rotors could cause the rocket to turn into the flow field and away from the intended target if the tail fins were deployed within 10 meters of the helicopter. Assuming that the boost phase extends beyond 10 meters, the designer can select and position a simple hold-down device to delay tail fin deployment. In the multi-tube launcher application, if the tail fins deploy immediately upon clearing the tube they can interfere with adjacent rockets extending from their tubes. In this case, the travel delay need only be sufficient for the rocket to clear the other rockets. Note, if a longer travel delay is required, it may be possible to extend the boost phase.

Figure 6:
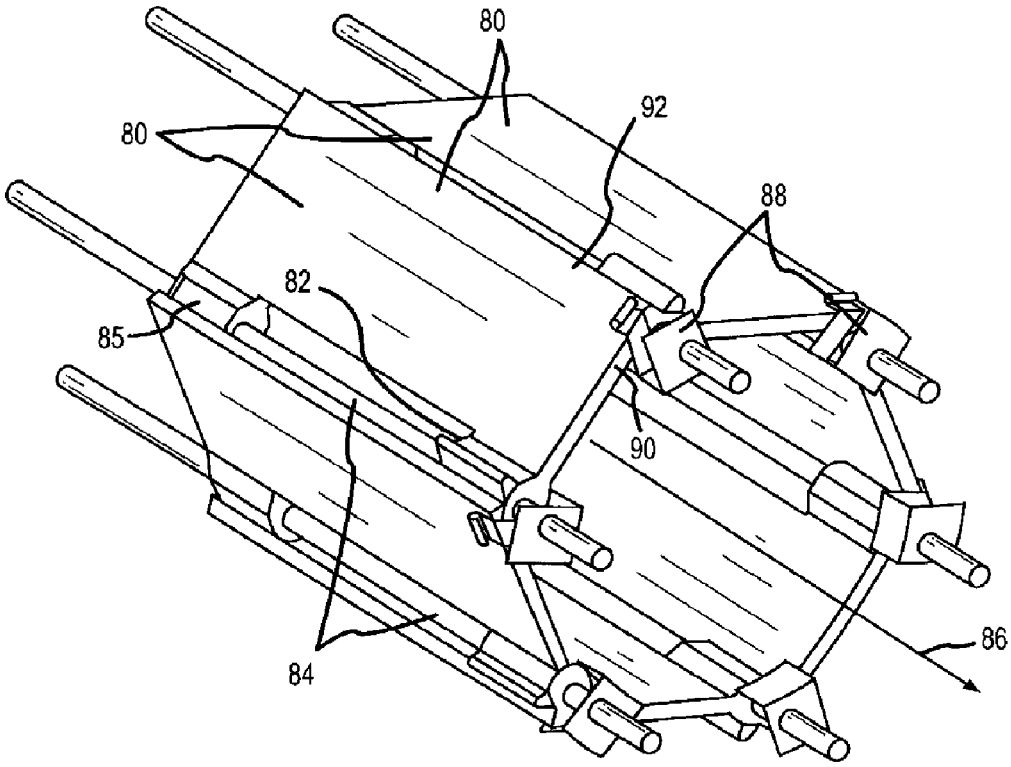
FIG. 6 is a perspective view of a multiple spring-cam fin deployment mechanism.
Figure 8:
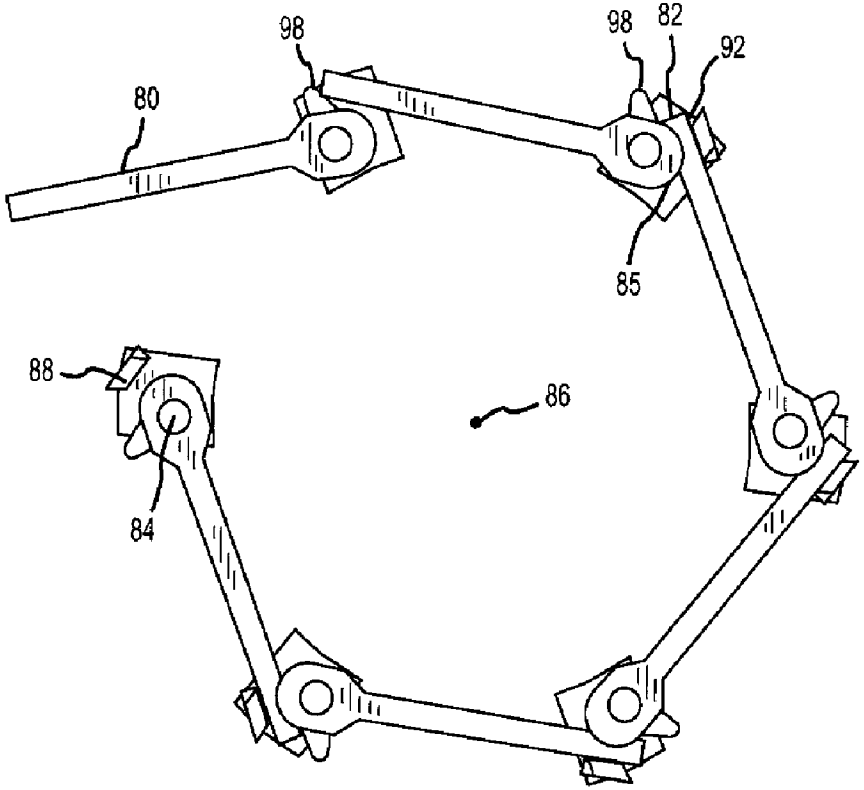
FIG. 8 is a section view of the deployment mechanism illustrating the daisy chain effect when the first fin is released.
Figure 7:
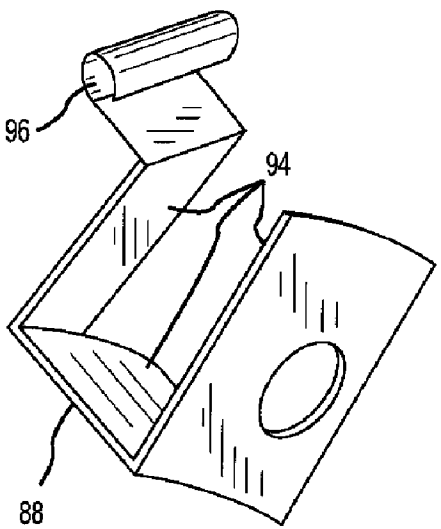
FIG. 7 is a perspective view of an exemplary hold down device.
Figure 9:
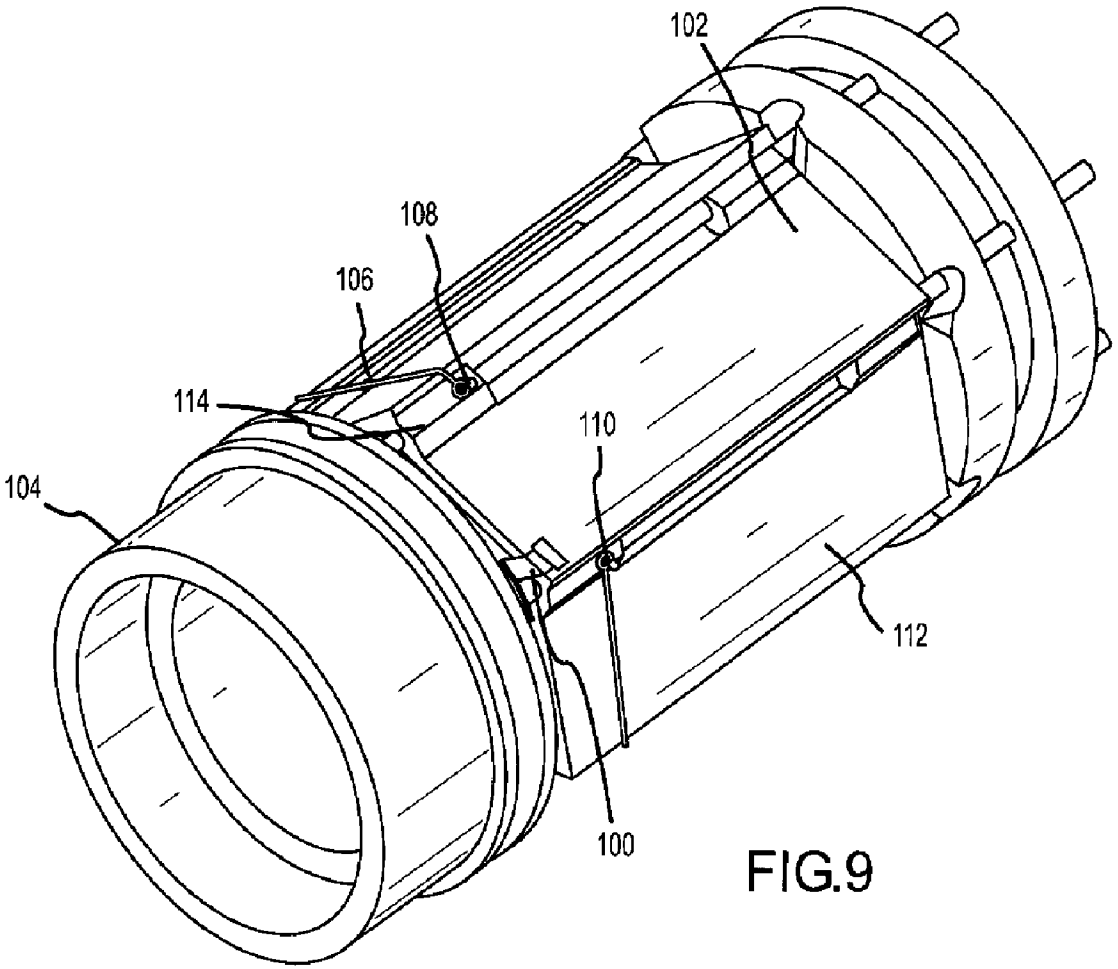
FIG. 9 is a perspective view of a single spring-lanyard fin deployment mechanism.
Figure 10:
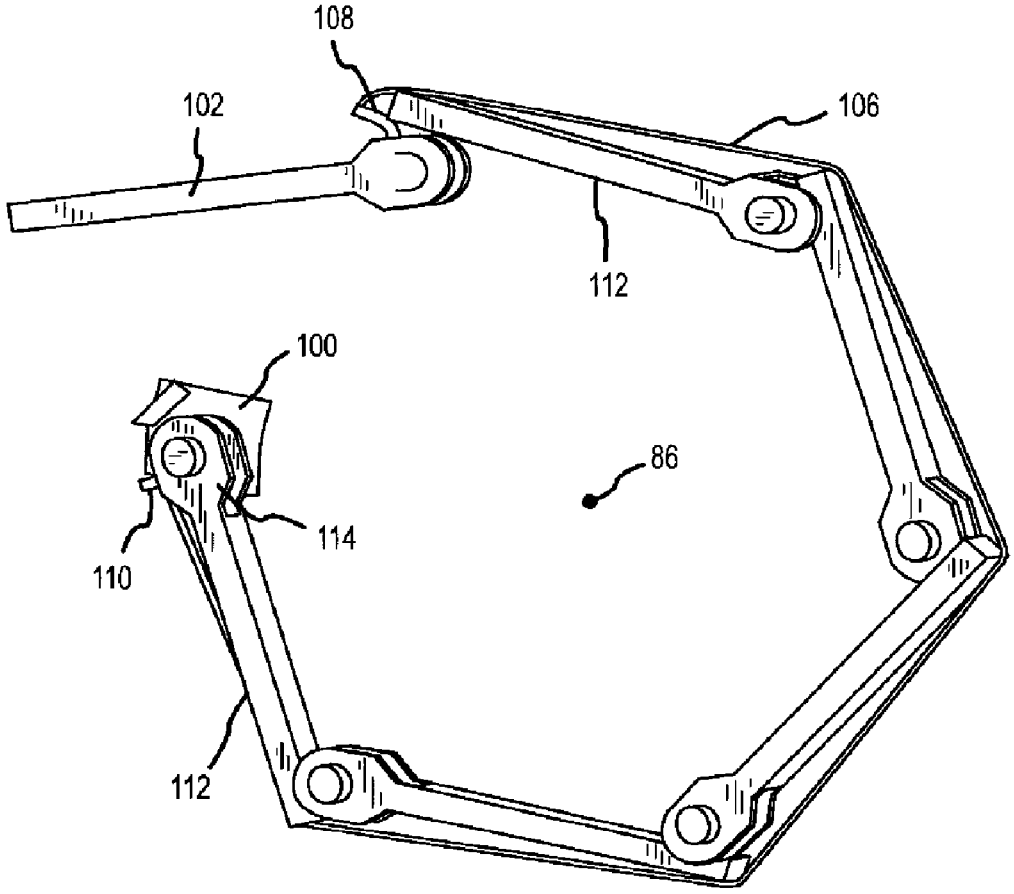
FIG. 10 is a section view of the deployment mechanism illustrating the release of the lanyard to deploy all of the fins.
Figure 11:
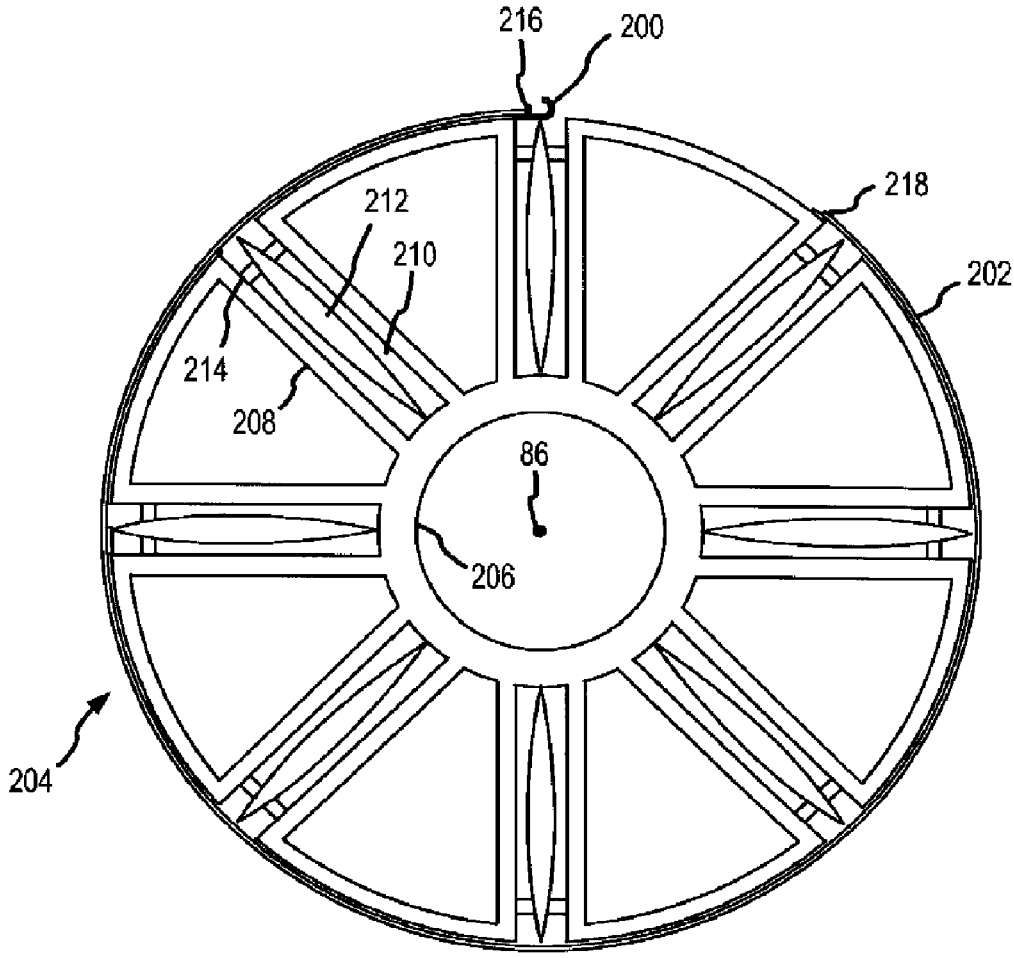
FIG. 11 is a view of an alternate embodiment of the single spring-lanyard fin deployment mechanism in which the fins are stowed in a jack-knife configuration inside the tail section.
Figure 12:
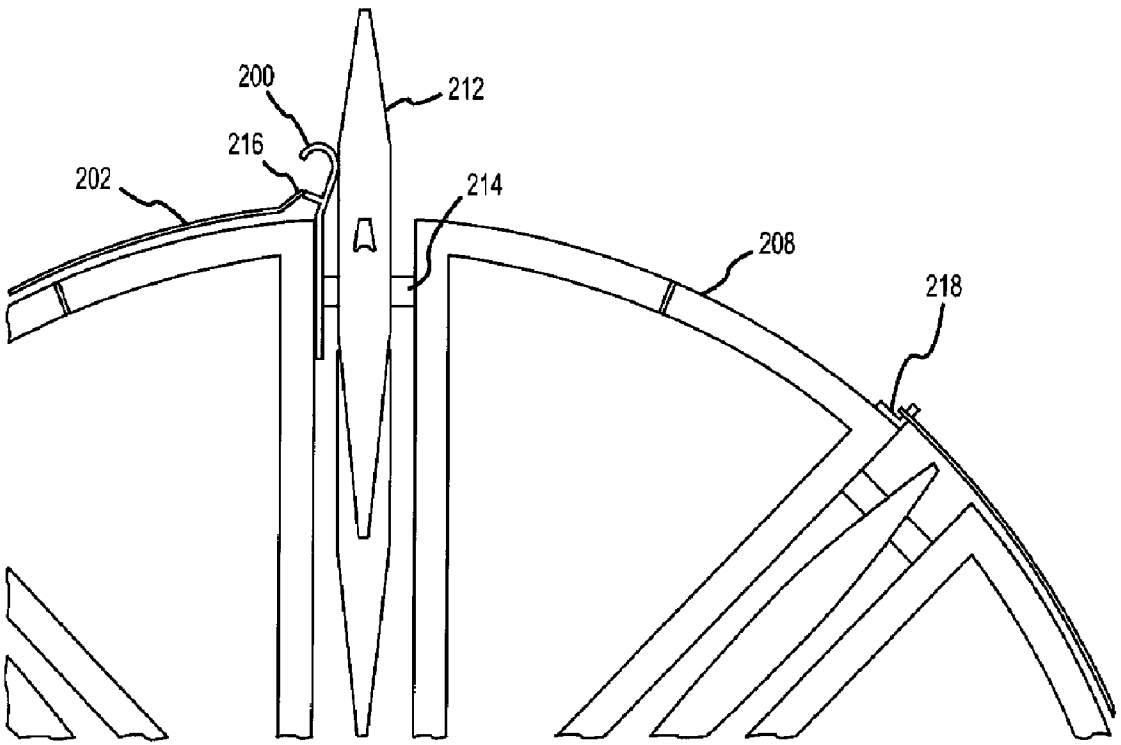
FIG. 12 is a diagram illustrating deployment of the primary fin thereby releasing the lanyard from the master lug.

A typical projectile will include a plurality of fins positioned around the circumference of the projectile's tail section. The fins may be flat or curved to wrap-around the projectile. Alternately, the fins may be jack-knifed inside the tail section. In one embodiment, each fin will be provided with a hold down device (FIGS. 6-8). Ideally each device will exhibit the same spring force so that all of the fins deploy at the same time. However, inevitably there is some variation in the spring forces that causes a degree of dispersion at the target. In another embodiment, a plurality of cams are positioned between adjacent fins so that when the hold down device having the weakest spring force releases, the deployment of its fin pushes the cam against the adjacent fin causing its hold down device to release and so forth in a daisy chain until all of the hold down devices have been released and the fins deployed (also FIGS. 6-8). The cams should reduce dispersion at the target. In yet another embodiment, only a primary fin is held in place with a hold down device. The remaining secondary fins are captured by a lanyard that is held between a pair of attachment lugs. The deployment of the primary fin releases the lanyard from at least one of the attachment lugs thereby allowing the secondary fins to deploy almost simultaneously (FIGS. 9-10). The single lanyard mechanism can also be adapted for use with the jack-knife fin configuration (FIGS. 11-12).

As shown in FIG. 6-8, a plurality of fins 80 are positioned around the circumference of the nozzle (not shown) and pivotally mounted along an interior longitudinal edge 82 on respective fin rotation pins 84 extending through fin hubs 85 along a main axis 86 of the projectile to swing from a stowed position against the nozzle to a deployed position. A like plurality of hold down devices 88 are positioned to hold the fins in their stowed positions. In this particularly embodiment, each hold down device 88 (best shown in FIG. 7) is positioned on the fin rotation pin 84 of the adjacent fin to hold the lateral edge 90 of the fin near its exterior longitudinal edge 92.

The hold down device is configured to provide a predetermined spring force opposing the deployment of the fin until the forcing moment is sufficiently large to overcome the spring force and push the hold down device out of the way. The spring force is determined by length, width, thickness, shape and material composition of walls 94 and can be defined and manufactured to a reasonable tolerance. Friction between the fin and hold down device has considerably more variation as it depends upon such unknowns as dirt, humidity etc. Consequently, it is generally desirable to design the hold down device (shape) to minimize friction. In this particular embodiment, the edge 96 of the hold down device that actually contacts the fin is rounded to minimize any friction between the fin and device as the fin pushes edge 96 outward from the projectile spin axis 86 during deployment. The rounded edge also reduces the likelihood that the edge will tear or otherwise damage the fin during deployment.

Ideally each hold down device 88 will exhibit the same spring force so that all of the fins deploy at the same time. However, inevitably there is some variation in the spring forces that causes a degree of dispersion at the target. To reduce dispersion, a like plurality of cams 98 are positioned between adjacent fins 82 so that when the hold down device 88 having the weakest spring force releases, the deployment of its fin 80 pushes the cam 98 against the adjacent fin causing its hold down device to release and so forth in a daisy chain until all of the hold down devices have been released and the fins deployed. In this particular fin configuration, the cams 98 are positioned axially between the interior longitudinal edge 82 of one fin and the exterior longitudinal edge 92 of the adjacent fin so that when the hold down device having the weakest spring force releases the deployment of its fin pushes the cam against the exterior longitudinal edge of the adjacent fin causing its hold down device to release and so forth in the daisy chain. The force exerted by the cams should be larger than any variance in the spring forces of the hold down devices. For the typical case in which all of the hold down devices are designed to have the same spring force, any one of the hold down devices may be the weakest and start the daisy chain. Alternately, a fin could be designated as the primary fin and its hold down device designed specifically to have the weakest spring force. The remaining secondary fins would have a higher designed spring force. When the primary hold down device releases, it starts the daisy chain and the cams provide sufficient additional force to deploy the secondary fins.

Although not shown, a typical deployment mechanism may also include a spring underneath each fin to more rapidly deploy the fin once released. If the spring assist is included the spring force of the hold down device is increased to offset the spring assist so that the tail fins deploy at the same delay. The only effect is that once the fins are released, the forcing moment includes both the centrifugal force and the spring assist so that the fin will deploy faster. A typical deployment mechanism may also include a fin locking mechanism on the fin hub that holds the fin its deployed position. The centrifugal force of the spinning projectile will tend to hold the fin in the deployed position but the locking mechanism provides an additional measure of stability and reliability. The locking mechanism can be a simple detent.

In an alternate embodiment shown in FIGS. 9 and 10, a single hold down device 100 is positioned to hold a primary fin 102 against the nozzle 104 in the tail section of the projectile. A lanyard 106 is secured between primary and secondary attachment lugs 108 and 110, respectively, around the projectile to restrain one or more secondary fins 112 in their stowed positions. The deployment of primary fin 102 releases the lanyard 106 from first attachment lug 108 thereby allowing the secondary fins 112 to deploy. Primary attachment lug 108 is suitably positioned on the primary fin 102 and preferably on the fin rotation hub 114 so that as the fin pushes (deploys) past the hold down device 100 to rotate into its deployed position, the primary lug 108 also rotates allowing the lanyard to slip off. The secondary attachment lug 110 is positioned elsewhere on the projectile, suitably on the rotation hub 114 of the last secondary fin 112. When the lanyard slips off, the centrifugal force pops open all of the secondary fins almost simultaneously. The spring assist and locking mechanism may also be used in this configuration.

Figure 1:
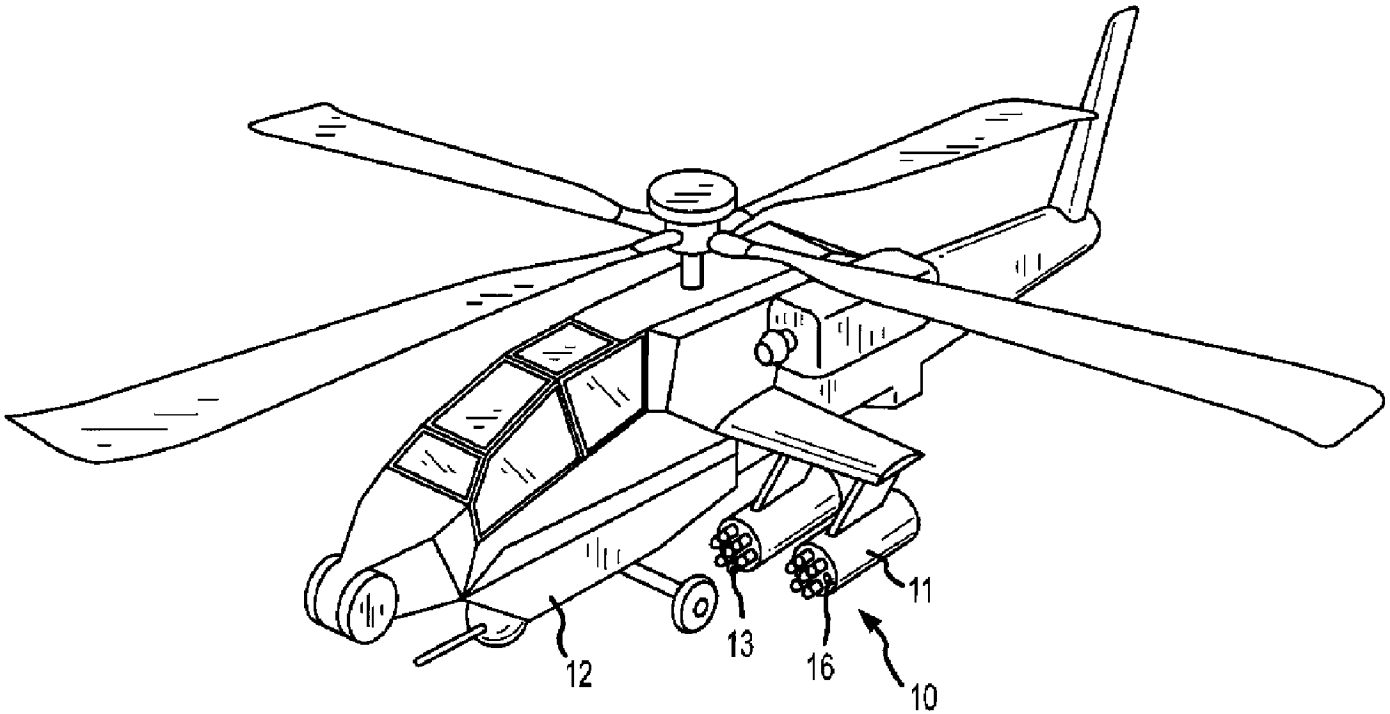
FIG. 1, as described above, is a diagram of a multi-tube rocket launcher mounted on a helicopter.

In an alternate embodiment shown in FIGS. 1 and 12, a single hold down device 200 and lanyard 202 are used to hold a plurality of fins in a jack-knifed configuration. U.S. Pat. Nos. 6,764,042 and 6,588,700 describe a tactical base for a guided projectile in which the fins are stored in a jack-knife configuration, which are hereby incorporated by reference. The projectile's tail section 204 can be similarly reconfigured by forming a plurality of conical sections 208 spaced around the nozzle 206 to define fin slots 210. Fins 212 are pivotably mounted on fin pins 214 within the fin slots in a stowed position. The hold down device 200 is positioned over one of the fin slots at a determined distance from the fin pin (measured along the longitudinal axis of the projectile), The primary lug 216 is positioned on the hold down device so that when the forcing moment of the centrifugal force exceeds the opposing moment of the hold down device the fin pushes past the hold down device causing primary lug 216 to rotate and release lanyard 202. The secondary lug 218 is suitably position on the conical section 208 past the last fin.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A delayed tail fin deployment mechanism, comprising:

a projectile having an engine and nozzle configured to spin up the projectile during a boost phase following launch;

a fin that is pivotally mounted on the projectile, said fin being stowed at launch so that the centrifugal force of the spinning projectile produces a moment that rotates the fin into a deployed position; and a hold down device that holds the fin in its stowed position until the moment of centrifugal force exceeds an opposing moment produced by a spring force of the hold down device, said spring force being predetermined to correspond to a particular spin rate of the projectile.

2. The fin deployment mechanism of claim 1, wherein the particular spin rate of the projectile is correlated to the travel distance of the projectile from launch.

3. The fin deployment mechanism of claim 1, further comprising a plurality of said fins positioned around the projectile and a like plurality of said hold down devices that hold respective fins in their stowed positions.

4. The fin deployment mechanism of claim 3, wherein all of said hold down devices are designed to release at the same spin rate.

5. The fin deployment mechanism of claim 4, wherein the spring force of said hold down devices will have some amount of variability, further comprising a plurality of cams positioned between adjacent fins so that when the hold down device having the weakest spring force releases the deployment of its fin pushes the cam against the adjacent fin causing its hold down device to release and so forth in a daisy chain until all of the hold down devices have been released and the fins deployed.

6. The fin deployment mechanism of claim 5, wherein each said fin has an interior longitudinal edge that is pivotally mounted along a main axis of the projectile and an exterior longitudinal edge, said cams are positioned axially between the interior longitudinal edge of one fin and the exterior longitudinal edge of the adjacent fin so that when the hold down device having the weakest spring force releases the deployment of its fin pushes the cam against the exterior longitudinal edge of the adjacent fin causing its hold down device to release and so forth in the daisy chain.

7. The fin deployment mechanism of claim 1, further comprising a primary fin and a plurality of secondary fins positioned around the projectile, said hold down device holding the primary fin in the stowed position, further comprising:

a first attachment lug;

a second attachment lug; and a lanyard between the first and second attachment lugs around said projectile that restrains the secondary fins in their stowed positions, wherein the deployment of the primary fin releases the lanyard from said first attachment lug thereby allowing the secondary fins to deploy.

8. The fin deployment mechanism of claim 7, wherein the first attachment lug is positioned on the primary fin and the second attachment lug is positioned elsewhere on the projectile.

9. The fin deployment mechanism of claim 8, wherein each said fin has an interior longitudinal edge that is pivotally mounted on a fin rotation hub along a main axis of the projectile and an exterior longitudinal edge, wherein the first attachment lug is positioned on the primary fin's fin rotation hub and the second attachment lug is positioned on the secondary fin's fin rotation hub immediately adjacent to the exterior longitudinal edge of the primary fin.

10. The fin deployment mechanism of claim 9, where the first attachment lug is configured so that the lanyard slips off when the primary fin's fin rotation hub rotates.

11. The fin deployment mechanism of claim 7, wherein the first attachment lug is positioned on the hold down device.

12. The fin deployment mechanism of claim 11, wherein the plurality of fins are stowed in a jack-knife configuration inside the projectile.

13. A delayed fin deployment mechanism for a weapon system, comprising:

a multi-tube rocket launcher, a plurality of rockets in and extending out from said tubes, each said rocket including:

a rocket engine and nozzle configured to propel and spin up the rocket during a boost phase following launch;

a fin that is pivotally mounted on the projectile, said fin being stowed at launch so that the centrifugal force of the spinning projectile produces a forcing moment that rotates the fin into a deployed position; and a hold down device that holds the fin in its stowed position until the forcing moment exceeds an opposing moment produced by a spring force of the hold down device, said spring force being predetermined to correspond to a particular spin rate of the projectile that is correlated to a travel distance of the projectile selected to clear adjacent rockets before the fins deploy.

14. The weapon system of claim 13, further comprising a plurality of said fins positioned around the rocket and a like plurality of said hold down devices that hold respective fins in their stowed positions.

15. The weapon system of claim 14, wherein the spring force of said hold down devices have some amount of variability, further comprising a plurality of cams positioned between adjacent fins so that when the hold down device having the weakest spring force releases the deployment of its fin pushes the cam against the adjacent fin causing its hold down device to release and so forth in a daisy chain until all of the hold down devices have been released and the fins deployed.

16. The weapon system of claim 13, further comprising a primary fin and a plurality of secondary fins positioned around the rocket, said hold down device holding the primary fin in the stowed position, further comprising:

a first attachment lug;

a second attachment lug; and a lanyard between the first and second attachment lugs around said rocket that restrains the secondary fins in their stowed positions, wherein the deployment of the primary fin releases the lanyard from said first attachment lug thereby allowing the secondary fins to deploy.

17. A method for delayed deployment of tail fins on a boosted fin-stabilized spinning projectile, comprising:

passively applying a spring force to hold a fin in its stowed position, said spring force corresponding to a particular spin rate of the projectile;

boosting the projectile over a boost phase to propel the projectile towards a target;

manipulating the boost to spin up the projectile; and passively releasing the fin to a deployed position when the centrifugal force of the spinning projectile produces a forcing moment that exceeds an opposing moment produced by the spring force.

18. The method of claim 17, further comprising:

correlating the particular spin rate at which the fins deploy to a desired travel distance.

19. The method of claim 17, wherein approximately the same spring force is applied to each of a plurality of fins positioned around the rocket so that when the fin having the weakest applied spring force deploys that fin interferes with the adjacent fin causing the adjacent fin to deploy and so forth in a daisy chain until all of the fins have been deployed.

20. The method of claim 17, wherein the spring force is applied to a single primary fin, further comprising looping a lanyard between first and second attachment lugs around said projectile to restrain a plurality of secondary fins in their stowed positions, whereby the deployment of the primary fin releases the lanyard from said first attachment lug thereby allowing the secondary fins to deploy.

* * * * *